United States Patent [19]

Kajikawa et al.

[11] 4,347,275

[45] Aug. 31, 1982

[54] CARPET TILE AND METHOD OF MAKING SAME

[75] Inventors: Teruo Kajikawa, Yokosuka; Sakuya Iwai, Tokyo, both of Japan

[73] Assignee: Nippon Petrochemical Company, Tokyo, Japan

[21] Appl. No.: 239,606

[22] Filed: Mar. 2, 1981

[51] Int. Cl.[3] ..... B05D 7/24; B32B 11/04

[52] U.S. Cl. ..... 428/95; 427/289; 427/293; 427/398.1

[58] Field of Search ..... 428/95, 97, 489; 427/208.4, 208.2, 289, 398.1, 442, 293

[56] References Cited

U.S. PATENT DOCUMENTS

| | | | |
|---|---|---|---|
| 3,459,695 | 8/1969 | Hedge et al. | 428/489 X |
| 3,941,904 | 3/1976 | Hoh et al. | 428/489 X |
| 4,282,127 | 8/1981 | Desgouilles | 427/442 X |

*Primary Examiner*—Evan K. Lawrence

*Attorney, Agent, or Firm*—Austin R. Miller

[57] ABSTRACT

Provided is a carpet tile produced by using as a backing material a mixture which contains a solvent deasphalted asphalt and a copolymer of an olefin and a polar monomer, or a mixture which contains an amorphous polyolefin in addition to the above components. After applying the mixture as a hot melt to the back of carpet material, the backed carpet material is cooled and then cut or punched to produce the carpet tile.

13 Claims, No Drawings

CARPET TILE AND METHOD OF MAKING SAME

BACKGROUND OF THE INVENTION

This invention relates to a new carpet tile and method of making same and particularly to an improvement of a backing material for carpet tiles.

Carpet tiles are square, rectangular, rhombic, or assume even more complicated shapes, and each provides a plate-like carpet having an area of for example 0.03 to 2 $m^2$. These carpet tiles are combined on a floor to provide a carpet without forming any clearance, and they are advantageous over ordinary types of carpets in that by merely fixing them onto a floor there can be formed a carpet easily and in that carpets of various impressions can be obtained by changing the combination of shape and color of carpet tiles. They are further advantageous in that when a portion thereof is stained or damaged the said portion alone can be replaced or repaired easily.

It is necessary that these carpet tiles when laid on a floor should adhere to the floor tightly enough to prevent them from partially coming off when a person walk thereon. As means for satisfying this requirement there is known the use of an adhesive or sticking agent or the use of needles or tacks. These methods, however, are disadvantageous in that their application is troublesome and the replacement of the carpet tiles laid on the floor by such methods takes more time and labor. As an improvement from such methods there is known the method in which a carpet tile itself is made heavier by the application of a backing material so that it has fixativity (laying stability). The said backing material is also intended to prevent the constituent threads of a carpet tile from coming off, to make the carpet tile stable dimensionally and to make it cushiony.

Thus, carpet tile backing materials must have a laying stability which allows the backed carpet tile to become stably fixed upon laying on a floor, in addition to the requirement that they must satisfy the requirements of backing materials for ordinary type carpets. And this laying stability must be imparted without using expensive materials.

Known heretofore as carpet backing materials are rubber latex type, elastomer type, synthetic resin type, and asphalt type, as is disclosed for example in Japanese Patent Publication Nos. 3839/1971, 20199/1973, 34556/1973, 17851/1977 and 4525/1978. However, the rubber latex type is disadvantageous in that, since its application must be followed by drying and vulcanization, there are required additional equipment and cost, and further in that the fibrous base material is damaged because during the said additional operation it is exposed to an elevated temperature for a long time. Heat melting types such as the elastomer type and the synthetic resin type have characteristics preferable to the rubber latex type, but are not desirable in point of cost performance. The asphalt type is less expensive, but the asphalt in ordinary use is insufficient in hardness and resistance to deformation under load, and when used as a backing material it can flow and move at ordinary temperature, resulting in the beauty of carpet tile being spoiled. Also from the standpoint of working environment the asphalt type is not desirable, because when heated in the backing operation it produces offensive odor and smoke.

SUMMARY OF THE INVENTION

It is an object of this invention to remedy the conventional drawbacks encountered in carpet tile backing materials.

It is another object of this invention to provide a carpet tile and method for producing the same satisfying the required hardness, resistance to deformation under load and working efficiency and being inexpensive, by the use of a backing material which possesses both the merits of synthetic resin type backing materials and the merits of asphalt type backing materials.

Other objects and advantages of this invention will become apparent from the following description.

The foregoing objects of this invention are achieved by heat-melting at 100° to 240° C. a mixture containing (a) 100 parts by weight of a solvent deasphalted asphalt and (b) 10 to 70 parts by weight of a copolymer of an olefin and a polar monomer with a polar monomer content of the copolymer being 0.5 to 20% by weight, then backing a carpet material with the molten mixture, cooling the backed carpet material and cutting or punching it as desired, and are also achieved by heat-melting at 100° to 240° C. a mixture containing (a) 100 parts by weight of a solvent deasphalted asphalt, (b) 5 to 70 parts by weight of a copolymer of an olefin and a polar monomer with a polar monomer content of the copolymer being 0.5 to 20% by weight and (c) 5 to 100 parts by weight of an amorphous polyolefin, then backing a carpet material with the molten mixture, cooling the backed carpet material and cutting or punching it as desired.

DETAILED DESCRIPTION OF THE INVENTION

The "solvent deasphalted asphalt" (component (a)) as referred to herein indicates a deasphalt (asphalt) obtained when extracting a petroleum distillation residue with a lower aliphatic hydrocarbon having 3 to 10 carbon atoms, e.g. propane, butane, or a mixture thereof. Preferably, the solvent deasphalted asphalt has a softening point (according to the ring and ball method) of 40° to 90° C., particularly 50° to 90° C., and a penetration (150 g, 5 sec., 25° C.) of 100 to 0, particularly 50 to 0. Propane deasphalted asphalt (hereinafter may be referred to simply as "PDA") is especially preferred. The solvent deasphalted asphalt no longer contains the components which are undesirable in the production of a carpet tile such as offensive odor emitting components and low flash point components, which have been removed by extraction treatment. But it still involves problems remaining to be solved such as fluidity at room temperature, brittleness and low softening point. Therefore, if it is used alone, the foregoing objects of this invention cannot be attained, it being necessary to combine it with other component(s) as will be described hereinafter.

In the copolymer of an olefin and a polar monomer (component (b)) as referred to herein, $C_2$ to $C_4$ olefins, preferably ethylene, may be employed as the olefin, while as the polar monomer there may be used those which are copolymerizable with the olefin, as preferably exemplified by vinyl monomers having carboxyl group or ester structure such as vinyl acetate, ethyl acrylate, methyl acrylate, methyl methacrylate, acrylic acid, methacrylic acid, or a mixture of two or more thereof. Preferred examples of the copolymer are ethylene-vinyl acetate copolymer, ethylene-ethyl acrylate copolymer, ethylene-methyl acrylate copolymer, and ethylene-ethyl acrylate-acrylic acid copolymer, among which ethylene-vinyl acetate copolymer (hereinafter may be referred to simply as "EVA") is particularly preferred. The content of the polar monomers in these copolymers is in the range of from 0.5 to 20% by weight, preferably from 1.0 to 15% by weight and most preferably above 1.0% and below 5.0% by weight. If the content of a polar monomer is below the said range, the copolymer containing the polar monomer will become less soluble in the solvent deasphalted asphalt, while if the polar monomer content exceeds the above range, the resulting backing material will become insufficient in point of hardness. It is preferable that the melt index of the copolymer be in the range of from 0.1 to 200, particularly from 0.2 to 100. At a melt index smaller than the lower limit just specified, the copolymer would dissolve more slowly in the solvent deasphalted asphalt resulting in that the working efficiency in the production decreases, while at a melt index value larger than the upper limit specified above, the softening point of the resulting backing material would become lower.

The amount of the copolymer of an olefin and a polar monomer (component (b)) is in the range of from 10 to 70 and preferably 15 to 60 parts by weight based on 100 parts by weight of the solvent deasphalted asphalt (component (a)). If its amount is below the said range, the resulting backing material will become fragile and lower in softening point, and thus the effect of its incorporation is not recognized, while if its amount exceeds the above range, the melt viscosity of the resulting backing material becomes higher so it is difficult to perform the backing operation and the expenses involved increase, which is not desirable from the economical point of view.

In this invention, there may be further blended an amorphous polyolefin (component (c)) in addition to the foregoing components (a) and (b). As the amorphous polyolefin as referred to herein there may be employed homopolymers or copolymers of $C_2$ to $C_4$ olefins. Particularly preferred are amorphous polypropylene (hereinafter may be referred to simply as "APP"), amorphous polybutene, and amorphous ethylene-propylene copolymer. It is preferable that the amorphous polyolefin have a viscosity-average molecular weight in the range of from 5,000 to 300,000, particularly from 10,000 to 100,000, determined by the Parini's equation $[\eta]=0.80\times10^{-4}M^{0.8}$ where $[\eta]$ is an intrinsic viscosity and M is a viscosity-average molecular weight. A viscosity-average molecular weight within the range just specified allows the amorphous polyolefin to promote the function and effect of the foregoing component (b), raise the softening point of the resulting backing material, improve the bending resistance (flexibility) at low temperatures and lower the melt viscosity in the backing operation thereby increasing the working efficiency.

In the case of adding the amorphous polyolefin (component (c)), it is added so as to give a mixing ratio of each component in the resulting mixture such that the copolymer of an olefin and a polar monomer (component (b)) and the amorphous polyolefin (component (c)) are in the proportions of 5 to 70, preferably 7 to 60, parts by weight and 10 to 150, preferably 20 to 100, parts by weight, respectively, based on 100 parts by weight of the solvent deasphalted asphalt (component (a)). If the amount of the amorphous polyolefin is smaller than the lower limit just specified, the foregoing effects of its incorporation will not be obtained to a satisfactory extent, while if such amount exceeds the above range, the melt viscosity of the resulting backing material will become higher so the working efficiency in the backing operation decreases.

In this invention, fillers may be incorporated in the aforesaid backing mixture. There may be used conventional fillers for rubbers and plastics, for example, those described in paragraphs 11 and 12 of the "Handbook—Blending Chemicals for Rubbers and Plastics," Rubber Digest Co. (1974), such as calcium carbonates, clays, silicas, carbon black, talc, barium sulfate, calcium sulfate, calcium sulfite, and zinc white. The addition of these fillers is intended to improve the softening point of the resulting backing mixture and to reduce the cost, further it is also desirable for making the backed carpet tile itself heavier to impart a laying stability thereto.

In order to improve the softening point and specific gravity of the backing mixture, it is desirable to use a larger amount of filler. But a too large amount thereof would result in an increase in melt viscosity and deterioration in processability of the resulting composition, and further the molded article as the final product tends to become fragile and cracked against deformation. It is preferable that the amount of filler be in the range of from 20 to 500, particularly 20 to 300, parts by weight based on 100 parts by weight of the solvent deasphalted asphalt.

The carpet material as referred to herein indicates ordinary carpets such as tufted carpet, woven carpet (Wilton or Axminster) and non-woven carpet (needle punch), as well as artificial lawns using such high polymer materials as polyamides, polyesters, polyvinylidene chloride and polypropylene.

In the case of using a primary base fabric in tufted carpet, non-woven carpet and artificial lawn, preferred materials for such primary base fabric are woven or non-woven fabrics consisting of one or more of natural and synthetic fibers such as jute, wool, rayon, polyamides, polyesters, polypropylene and polyethylene. Particularly preferred are woven or non-woven fabrics obtained from highly heat-resistant polyamides or polyesters, or mixtures thereof with polypropylene or polyethylene. The pile-material and shape of the carpet material are not restricted, there may be used any material and shape. If required, moreover, the carpet material may be precoated with latex or emulsion of natural or synthetic rubbers or synthetic resins.

The components of the backing mixture are melted and mixed at 100° to 240° C., preferably 120° to 180° C., then the carpet material is backed with the molten mixture in the same temperature range according to the doctor knife coater method or the roll coater method, the so-backed carpet material is cooled and thereafter cut or punched as desired whereby a carpet tile can be produced. If the melting and mixing temperature and the backing temperature are lower than the above-specified range, a homogeneous backing mixture will not be obtained, and the adhesion to the carpet material will become insufficient. It is not necessary at all to raise the melting and mixing temperature and the backing temperature beyond the above-specified range. Raising those temperatures to such an extent is not desirable from the commercial point of view, for example, it would require an additional fuel cost, and further such high temperatures can result in shrinkage or damage of the carpet material.

In this invention, the backing material may be underlaid with a secondary base fabric or a releasing material such as a woven or non-woven fabric consisting of natural or synthetic fiber, a synthetic resin film, or paper, with a view to producing a carpet tile having more preferable properties.

Working and comparative examples are given below to illustrate the invention more concretely.

Various backing mixtures as will be tabulated later were prepared, and carpet tiles were produced using those backing mixtures. The following are the details of how to prepare the backing mixtures, how to produce the carpet tiles and how to conduct various tests.

HOW TO PREPARE BACKING MIXTURES

Method I: The solvent deasphalted asphalt is placed in a mixing furnace, followed by the addition of the amorphous polyolefin if required, then heat-melted at 100°-160° C.

The copolymer of an olefin and a polar monomer is then added and the temperature raised to 180°-240° C. while stirring is made until the added polymer particles disappear and are dissolved. When the mixture becomes a homogeneous melt, the temperature is adjusted to the backing temperature.

Method II: The copolymer of an olefin and a polar monomer is placed in a pressure kneader and mixed under heat at 140°-160° C. Then small amounts of the amorphous polyolefin and the solvent deasphalted asphalt are added and mixed under heat. When the mixture becomes a homogeneous melt, the temperature is adjusted to the backing temperature.

HOW TO PRODUCE CARPET TILES

Method I (Doctor Knife Coater Method):

The carpet material is put on a conveyor belt so that it is turned inside out, and while the molten backing mixture is poured thereonto it is applied in constant thickness, e.g. 1 to 5 mm, by means of a doctor knife. A secondary base fabric is sticked thereon if required, then the so-coated mass is cooled and cut into desired size and shape with a cutting machine to produce carpet tiles.

Method II (Roll Coater Method):

Between two rolls disposed almost horizontally side by side at a predetermined interval there are fed the carpet material from one upper side and secondary base fabric or releasing paper from the other upper side, while the molten backing mixture is poured therebetween from above, under which condition the rolls are rotated to form a carpet of a fixed thickness. After cooling, the carpet is cut into predetermined size and shape by means of a cutting machine to produce carpet tiles.

Testing Methods

Softening Point: According to the ring and ball method defined by JIS K 2531. Softening points not lower than 100° C., particularly not lower than 105° C., are preferred.

Hardness: Determined at 20° C. according to the spring method defined by JIS K 6301. Hardness values not smaller than 75 are preferred.

Load Resistance: Sample is formed into a cylinder (3 cm radius, 1 cm thickness), on which is imposed a load using a cylinder weighing 2.5 kg. with a sectional area of 0.5 $cm^2$, for 15 minutes at 20° C. or 40° C. The change in thickness of the sample is measured through a thickness gauge. It is preferable that such change be not larger than 1.5 mm.

Bending Resistance: Sample is formed into a 100×10×2 mm sheet.

The sheet is bent 180-deg. about a 6 mm-dia. rod at 10° C. and its bending resistance is evaluated. X: broken, ○: not broken.

Fluidity: 50×50×3 mm sample is sticked on a glass plate, which is then put upright in the air at 80° C. and checked to see if there is any flow.

Melt Viscosity: Determined by the use of a rotational viscometer.

It is preferable that the melt viscosity at 160° C. be not higher than 80,000 cp and that at 200° C. it be not higher than 20,000 cp.

Yarn Extraction Strength: Determined according to JIS L 1021. It is preferable that the yarn extraction strength be not lower than 2.5 kg/2 pcs.

Dimensional Stability: According to BS 4682 Pt3. A 30×30 cm square carpet tile is heated in the air at 60° C. for 2 hours, and a dimensional change after the heating is measured. (−): shrinkage, (+): elongation. It is preferable that the dimensional change be not larger than ±0.1%.

Working Efficiency when laying carpet tiles on a floor: Carpet tiles difficult to lay on a floor because of excessive softness or deficiency of stiffness are considered to be bad.

| | | Examples | | | | Comparative Examples | |
|---|---|---|---|---|---|---|---|
| | | 1 | 2 | 3 | 4 | 1 | 2 |
| Backing Mixtures | (a) PDA | 100 wt. parts | 100 wt. parts | 100 wt. parts | 100 wt. parts | 100 wt. parts | 100 wt. parts |
| | (Penetration / Softening Point (°C.)) | (10 / 60) | (6 / 70) | (8 / 65) | (8 / 65) | (6 / 70) | (6 / 70) |
| | (b) EVA | 40 wt. parts | 25 wt. parts | 18 wt. parts | 15 wt. parts | — | 40 wt. parts |
| | (VA (%) / MI) | (10 / 3.0) | (3.0 / 10) | (4.5 / 2.0) | (4.0 / 4.0) | | (28 / 15) |
| | (c) APP | — | — | 18 wt. parts | 20 wt. parts | 40 wt. parts | — |
| | (Viscosity-avg. molecular wt. / Softening Point (°C.)) | | | ($3.5 \times 10^4$ / 152) | ($3.0 \times 10^4$ / 140) | ($3.5 \times 10^4$ / 152) | |
| | Calcium Carbonate | — | — | — | 100 wt. parts | — | — |
| Mixture Preparing Method | | II | I | I | II | I | II |
| Properties of the | Softening Point (°C.) | 110 | 107 | 106 | 120 | 110 | 88 |
| | Hardness | 84 | 91 | 92 | 94 | 72 | 55 |

-continued

| | | Examples | | | | Comparative Examples | |
|---|---|---|---|---|---|---|---|
| | | 1 | 2 | 3 | 4 | 1 | 2 |
| Mixtures | Load Resistance (mm) | | | | | | |
| | at 20° C. | 0.12 | 0.25 | 0.30 | 0.11 | 0.40 | 0.40 |
| | at 40° C. | 0.25 | 1.33 | 1.20 | 0.30 | 6.20 | 3.28 |
| | Bending Resistance | | | | | | |
| | at 10° C. | ○ | ○ | ○ | ○ | X | ○ |
| | Fluidity | Non | Non | Non | Non | Non | Non |
| | Melting Viscosity (cp) | | | | | | |
| | at 160° C. | 55,000 | 15,000 | 35,000 | 40,000 | 12,000 | 43,000 |
| | at 200° C. | 18,000 | 5,000 | 8,000 | 10,000 | 4,000 | 12,000 |
| Carpet Tile Producing Method | | II | I | I | II | I | II |
| Carpet Tile Characteristics | Yarn Extraction Strength (kg/2pcs) | 5.2 | 3.8 | 3.0 | 3.1 | 1.5 | 2.8 |
| | Dimensional Stability (%) | +0.01 | +0.02 | +0.04 | +0.02 | +0.15 | +0.13 |
| | Working Efficiency when laying on a floor | Good | Good | Good | Good | Bad | Bad |
| | Overall Evaluation | Acceptance | Acceptance | Acceptance | Acceptance | Rejection | Rejection |

Examples 1 and 2 are manufacturing examples according to this invention, in which a carpet tile was backed with a backing mixture consisting of PDA (propane deasphalted asphalt, component (a)) and EVA (ethylene-vinyl acetate copolymer, component (b)). The VA and MI in the table represent vinyl acetate and melt index, respectively. The backing mixtures prepared in Examples 1 and 2 satisfied the requirements with respect to all the properties tested, i.e. softening point, hardness, load resistance, bending resistance, fluidity and melt viscosity, and the carpet tiles backed with those mixtures exhibited very good characteristics superior in yarn extraction strength, dimensional stability and working efficiency when laying on a floor.

Example 3 is a manufacturing example according to this invention, in which a carpet tile was backed with a backing mixture consisting of PDA (propane deasphalted asphalt, component (a)), EVA (ethylene-vinyl acetate copolymer, component (b)) and APP (amorphous polypropylene, component (c)). Example 4 is also a manufacturing example according to this invention, in which a carpet tile was backed with a backing mixture consisting of the backing mixture prepared in Example 3 and calcium carbonate incorporated therein as a filler. Like Examples 1 and 2, the backing mixtures prepared in Examples 3 and 4 satisfied the requirements with respect to all the properties tested, and the carpet tiles backed with those mixtures exhibited very good characteristics superior in yarn extraction strength, dimensional stability and working efficiency when laying on a floor.

Comparative Example 1 is a manufacturing example using a mixture not containing the olefin-polar monomer copolymer. Comparative Example 2 is a manufacturing example using the olefin-polar monomer copolymer with a polar monomer content exceeding 20% by weight. Both mixtures were insufficient in load resistance and in hardness, so that the carpet tiles backed with them were inferior in dimensional stability and in working efficiency when laying on a floor. Furthermore, the backed carpet tile produced in Comparative Example 1 proved to be poor also in yarn extraction strength.

We claim:

1. Method of making a carpet tile, which comprises heat-melting a mixture at 100°–240° C., said mixture containing (a) 100 parts by weight of a solvent deasphalted asphalt and (b) 10 to 70 parts by weight of a copolymer of an olefin and a polar monomer with the polar monomer content of the copolymer being 0.5 to 20% by weight, backing a carpet material with the molten mixture, cooling the backed carpet material and then cutting or punching the backed carpet material as desired to produce the carpet tile.

2. Method of making a carpet tile, which comprises heat-melting a mixture at 100°–240° C., said mixture containing (a) 100 parts by weight of a solvent deasphalted asphalt, (b) 5 to 70 parts by weight of a copolymer of an olefin and a polar monomer with the polar monomer content of the copolymer being 0.5 to 20% by weight and (c) 5 to 100 parts by weight of an amorphous polyolefin, backing a carpet material with the molten mixture, cooling the backed carpet material and then cutting or punching the backed carpet material as desired to produce the carpet tile.

3. The method as defined in any of claims 1 or 2, in which said solvent deasphalted asphalt is a propane deasphalted asphalt.

4. The method as defined in any of claims 1 or 2, in which said olefin is an olefin having 2 to 4 carbon atoms.

5. The method as defined in any of claims 1 or 2, in which said polar monomer is a vinyl monomer having a carboxyl group or ester linkage.

6. The method as defined in any of claims 1 or 2, in which said copolymer is a member selected from the group consisting of ethylene-vinyl acetate copolymer, ethylene-ethyl acrylate copolymer, ethylene-methyl acrylate copolymer, and ethylene-ethyl acrylate-acrylic acid copolymer.

7. The method as defined in any of claims 1 or 2, in which the melt index of said copolymer is in the range of from 0.1 to 200.

8. The method as defined in claim 1 or 2, in which said amorphous polyolefin is a polymer of $C_2$ to $C_4$ olefin.

9. The method as defined in claim 1 or 2, in which said mixture further contains a filler.

10. A carpet tile produced according to the method as defined in claim 1 or 2.

11. The method as defined in claim 1 or 2, wherein said backed carpet material is cut by means of a punch.

12. A carpet tile comprising:

(i) an unbacked carpet material;

(ii) a backing further comprising:

(a) 100 parts by weight of a solvent deasphalted asphalt, and (b) 10 to 70 parts by weight of a copolymer of an olefin and a polar monomer with the polar monomer content of the copolymer being 0.5 to 20% by weight.

13. A carpet tile comprising:

(i) an unbacked carpet material;

(ii) a backing further comprising:

(a) 100 parts by weight of a solvent deasphalted asphalt;

(b) 5 to 70 parts by weight of a copolymer of an olefin and a polar monomer with the polar monomer content of the copolymer being 0.5 to 20% by weight; and (c) 5 to 100 parts by weight of an amorphous polyolefin.

* * * * *